US007013523B2

(12) United States Patent
Chang

(10) Patent No.: US 7,013,523 B2
(45) Date of Patent: Mar. 21, 2006

(54) BATHING BALL

(76) Inventor: Che-Yuan Chang, No. 1, Lane 147, Sec. 2, Chung San Rd., Yun Lin, Chang Hua Hsien (TW)

( * ) Notice: Subject to any disclaimer, the term of this patent is extended or adjusted under 35 U.S.C. 154(b) by 237 days.

(21) Appl. No.: 10/373,795

(22) Filed: Feb. 27, 2003

(65) Prior Publication Data

US 2004/0000019 A1 Jan. 1, 2004

(30) Foreign Application Priority Data

Jun. 27, 2002 (TW) ..... 91209716 U

(51) Int. Cl.
*A47K 7/02* (2006.01)
*A47L 17/08* (2006.01)

(52) U.S. Cl. ..... 15/209.1; 15/229.11

(58) Field of Classification Search ..... 15/209.1, 15/229.11, 229.12, 229.13, 229.14, 210.1, 15/118; 300/21
See application file for complete search history.

(56) References Cited

U.S. PATENT DOCUMENTS 5,802,659 A * 9/1998 Chang ..... 15/222
6,092,257 A * 7/2000 Chen ..... 15/209.1
6,510,577 B1 * 1/2003 Borcherds et al. ..... 15/118
6,601,259 B1 * 8/2003 Chang ..... 15/209.1

* cited by examiner

*Primary Examiner*—John Kim
*Assistant Examiner*—Shay L. Balsis
(74) *Attorney, Agent, or Firm*—Browdy and Neimark, PLLC

(57) ABSTRACT

A bathing ball is constructed to include a first endless tube of lace-like fabric, a second endless tube of lace-like fabric, a first binder fastened to the first endless tube of lace-like fabric to tie up a middle part of the first endless tube of lace-like fabric, for enabling the first endless tube of lace-like fabric to be stretched into a first spherical body, and a second binder fastened to a middle part of the second endless tube of lace-like fabric and the tied up middle part of the first endless tube of lace-like fabric, for enabling the second endless tube of lace-like fabric to be stretched into a second spherical body around the periphery of the first spherical body

9 Claims, 4 Drawing Sheets

BATHING BALL

BACKGROUND OF THE INVENTION

1. Field of the Invention

The present invention relates to bathing balls for cleaning the body and, more particularly, to such a bathing ball which has bulky portions rising one upon another.

2. Description of the Related Art

A variety of bathing balls are commercially available. These bathing balls attract consumers by their unique outer appearances. These bathing balls commonly use a net or sponge matching with an ornamental body to cause a sense of beauty. The ornamental body has the function of absorbing applied bathing gel and causing applied bathing gel to produce bubbles when rubbed against the body. However, when directly rubbing the ornamental body against the body, it does not give a comfortable touch. Further, the ornamental body is inferior to the net in causing applied bathing gel to produce bubbles.

SUMMARY OF THE INVENTION

The present invention has been accomplished to provide a bathing ball, which eliminates the aforesaid drawbacks. It is the main object of the present invention to provide a bathing ball, which has portions rising upon another, causing a sense of beauty.

It is another object of the present invention to provide a bathing ball, which gives a comfort of touch.

To achieve these objects of the present invention, the bathing ball comprises a first endless tube of lace-like fabric, a second endless tube of lace-like fabric, a first binder fastened to the first endless tube of lace-like fabric to tie up a middle part of the first endless tube of lace-like fabric, for enabling the first endless tube of lace-like fabric to be stretched into a first spherical body, and a second binder fastened to a middle part of the second endless tube of lace-like fabric and the tied up middle part of the first endless tube of lace-like fabric, for enabling the second endless tube of lace-like fabric to be stretched into a respective second spherical body around the periphery of the first spherical body.

DETAILED DESCRIPTION OF THE INVENTION

Figure 1:
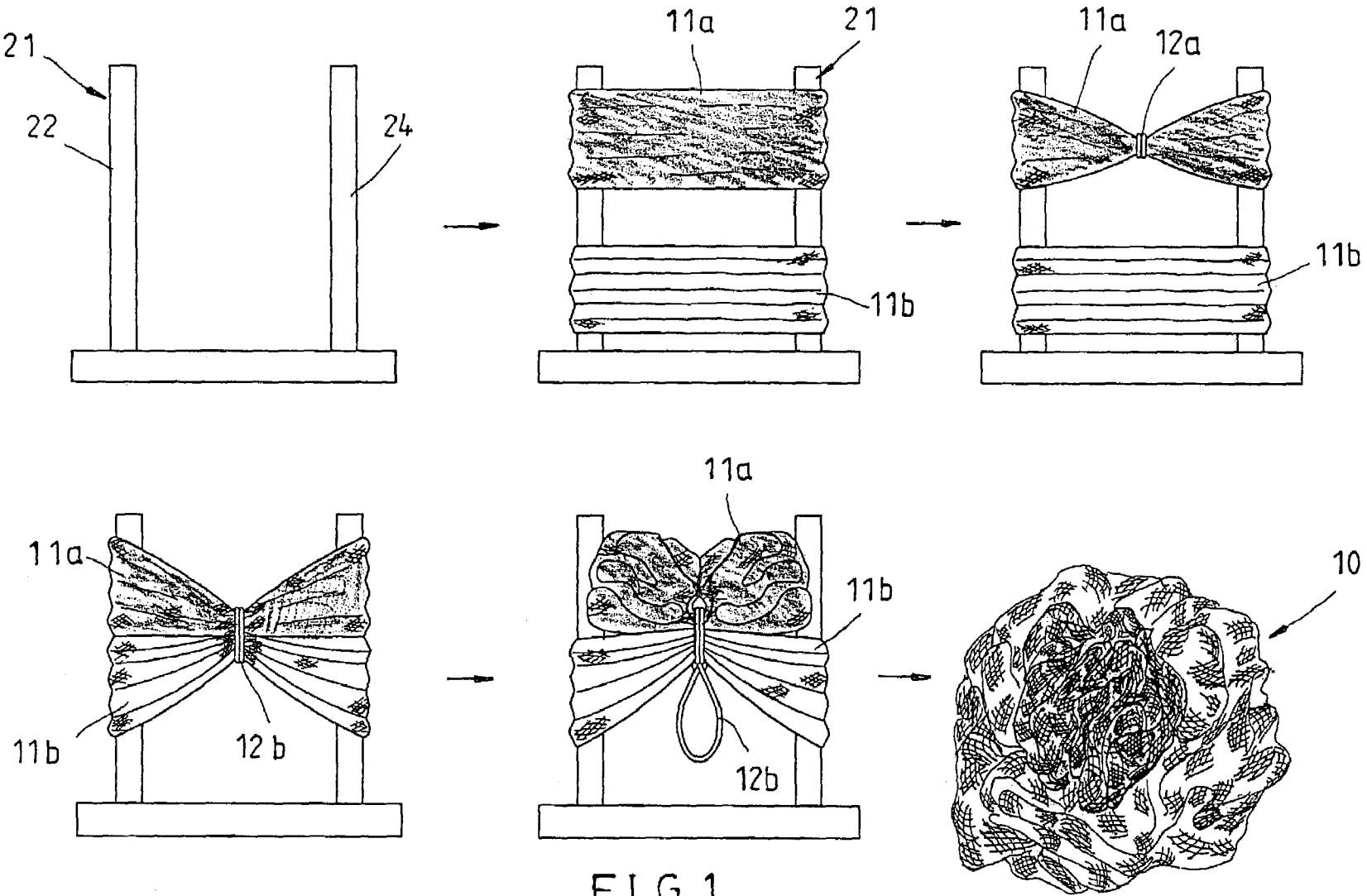
FIG. 1 is a bathing ball fabrication flow chart according to the present invention.

Referring to FIG. 1, a bathing ball 10 in accordance with the first preferred embodiment of the present invention is formed of endless tubes of lace-like fabric 11 and equal number of binders 12. According to this embodiment, the bathing ball 10 is comprised of two endless tubes of lace-like fabric 11*a* and 11*b*, and two binders 12*a* and 12*b*. The endless tubes of lace-like fabric 11*a* and 11*b* are respectively sleeved onto the two parallel uprights 22 and 24 of a rack 21, keeping the first endless tube of lace-like fabric 11*a* spaced above the second endless tube of lace-like fabric 11*b*, and then the first binder 12*a* is fastened to the first endless tube of lace-like fabric 11*a* to tie up the middle part of the first endless tube of lace-like fabric 11*a*, and then the second binder 12*b* is fastened to the middle part of the second endless tube of lace-like fabric 11*b* and the middle part of the first endless tube of lace-like fabric 11*a* to secure the first and second endless tubes of lace-like fabric 11*a* and 11*b* together, and then the first endless tube of lace-like fabric 11*a* is stepwise pulled out of the uprights 22 and 24 of a rack 21, and then the two symmetrical halves of the first endless tube of lace-like fabric 11*a* are alternatively stretched into a first spherical body, and then the second endless tube of lace-like fabric 11*b* is stretched into a second spherical body around the periphery of the first spherical body. Because the endless tubes of lace-like fabric 11 give a soft touch, the bathing ball 10 is comfortable in use.

Figure 2:
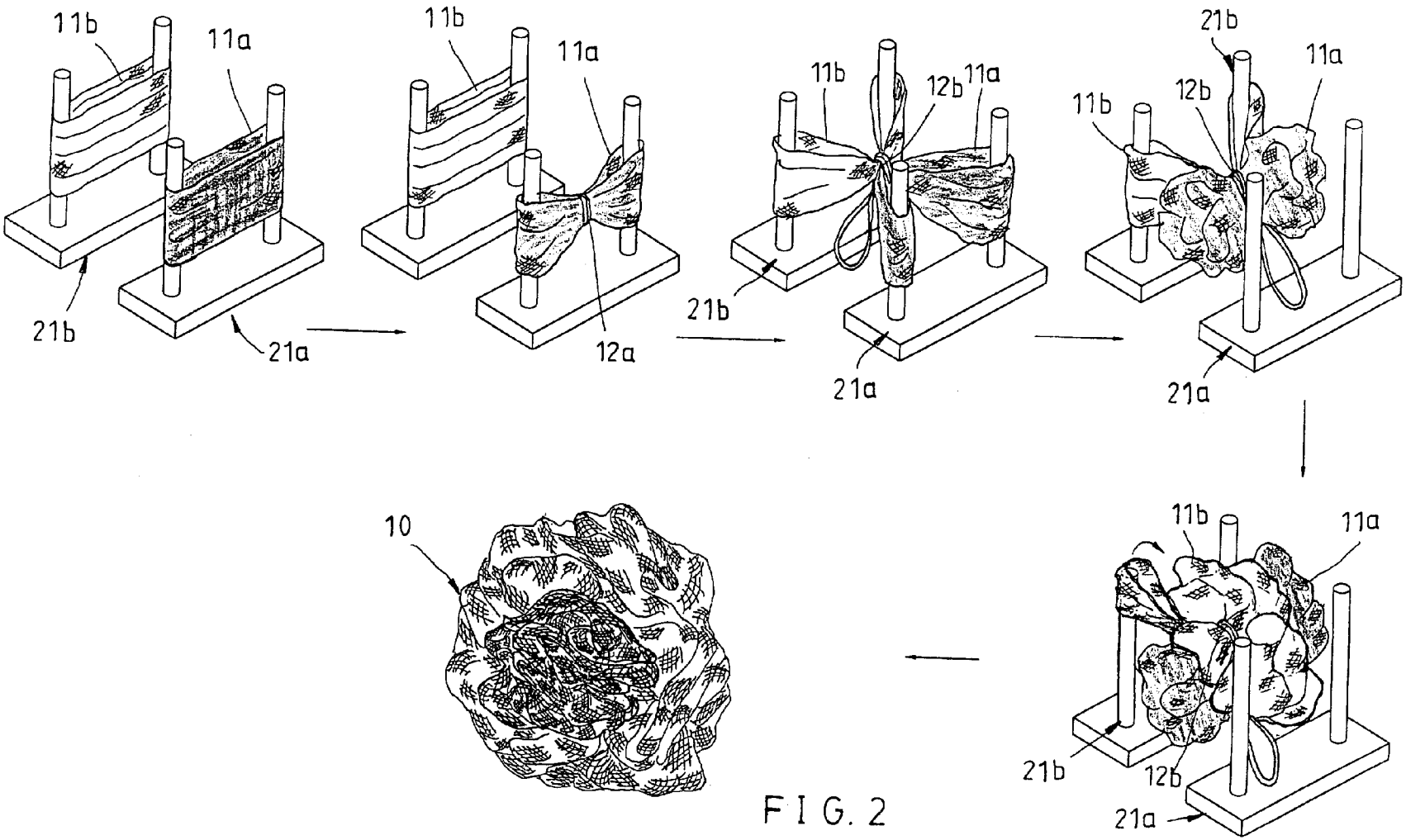
FIG. 2 shows an alternate form of the bathing ball fabrication flow chart according to the present invention.

FIG. 2 shows an alternate form of the bathing ball fabrication flow chart according to the present invention. According to this embodiment, the bathing ball 10 is formed of two endless tubes of lace-like fabric 11*a* and 11*b*, and two binders 12*a* and 12*b*. The endless tubes of lace-like fabric 11*a* and 11*b* are respectively sleeved onto a first rack 21*a* and a second rack 21*b* (Similar to the rack shown in FIG. 1, each rack 21*a* or 21*b* comprises two parallel uprights), and then the first binder 12*a* is fastened to the first endless tube of lace-like fabric 11*a* to tie up the middle part of the first endless tube of lace-like fabric 11*a*, and then the second binder 12*b* is fastened to the middle part of the second endless tube of lace-like fabric 11*b* and the middle part of the first endless tube of lace-like fabric 11*a* to secure the first endless tube of lace-like fabric 11*a* and the second endless tube of lace-like fabric 11*b* together, and then the first endless tube of lace-like fabric 11*a* is stepwise removed from the first rack 21*a*, i.e. the two symmetrical halves of the first endless tube of lace-like fabric 11*a* are alternatively stretched into a first spherical body, and then the second endless tube of lace-like fabric 11*b* is stepwise removed from the second rack 21*b* also, i.e. the two symmetrical halves of the second endless tube of lace-like fabric 11*b* are alternatively stretched into a second spherical body around the periphery of the first spherical body.

According to the aforesaid first and second embodiments of the present invention shown in FIGS. 1 and 2, the first and second endless tube of lace-like fabric 11*a* and 11*b* can be made of different lace-like fabrics (for example, different sizes, different wrinkle status, or different thread thickness) to provide different sense of touch. Because the bathing ball 10 is formed of a plurality of endless tube of lace-like fabric 11, applied bathing gel can easily be rubbed into bubbles for cleaning the body.

Figure 3:
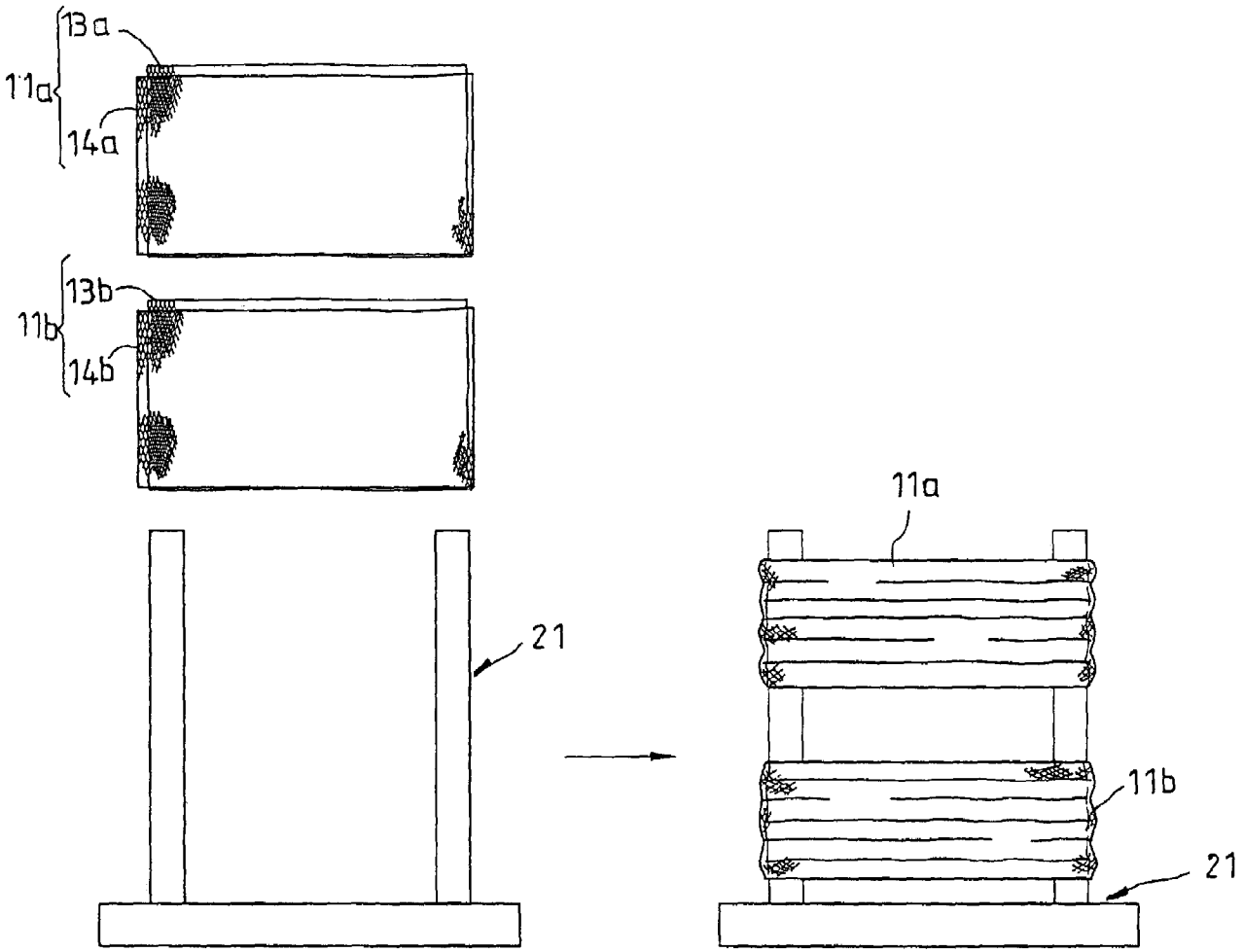
FIG. 3 is a schematic drawing showing an alternate form of the endless tubes of lace-like fabric according to the present invention.

FIG. 3 shows the fabrication of another alternate form of the present invention. According to this embodiment, the first endless tube of lace-like fabric 11*a* is comprised of two layers of endless tubes of lace-like fabric of different colors 13*a* and 14*a* arranged with one inside the other, and the second endless tube of lace-like fabric 11*b* is comprised of two layers of endless tubes of lace-like fabric 13*b* and 14*b* arranged with one inside the other. The two endless tubes of lace-like fabric 11*a* and 11*b* are fastened together and stretching into the desired bathing ball in the same fabrication procedure as shown in FIG. 1 or FIG. 2.

Figure 4:
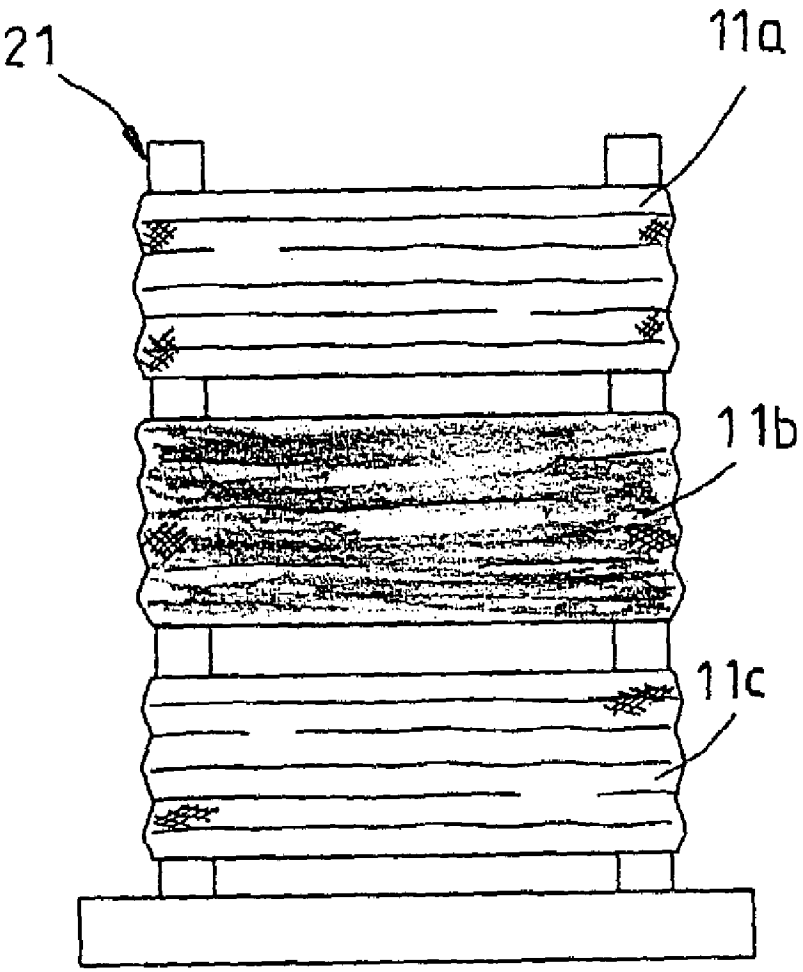
FIG. 4 is a schematic drawing showing three endless tubes of lace-like fabric mounted on a rack for making a bathing ball according to the present invention.

FIG. 4 shows the fabrication of still another alternate form of the present invention. According to this embodiment, three endless tubes of lace-like fabric 11*a*, 11*b*, and 11*c* are used to make the desired bathing ball.

As indicated above, the invention has the following advantages:

1. The bathing ball has portions rising one upon another, giving a variable sense of touch.

2. Because the portions of the bathing ball rise one upon another, they cause a sense of beauty.

3. Because the bathing ball is formed of at least two different endless tube of lace-like fabric, it removes dirt from the body effectively when rubbing against the skin of the body.

What is claimed is:

1. A bath ball comprising:

a first endless tube made of fabric;

a second endless tube made of fabric;

a first binder fastened at a middle part of said first endless tube which forms two first halves in said first endless tube;

a second binder fastened to a middle part of said second endless tube which forms two second halves in said second endless tube;

said second binder also fastened to said middle part of said first endless tube so that said first endless tube and said second tube are fixed to abut at the middle parts thereof;

wherein said two first halves are engaged together to form an inner body; and wherein said two second halves are stretched over the periphery of said inner body to form an outer surface over said inner body.

2. The bathing ball as claimed claim 1, wherein said first endless tube and said second endless tube have different softness.

3. The bathing ball as claimed in claim 1, wherein said first endless tube and said second endless tube each are comprised of multiple layers of endless tubes of lace fabric arranged with one inside the other.

4. The bathing ball as claimed in claim 3, wherein said layers of endless tubes of lace fabric have different colors.

5. The bathing ball as claimed in claim 1, wherein said fabric of said first tube is laced.

6. The bathing ball as claimed in claim 1, wherein said fabric of said second endless tube is laced.

7. The bathing ball as claimed in claim 1, wherein said inner body is spherical.

8. The bathing ball as claimed in claim 1, wherein said two first halves and said two second halves are symmetrical.

9. The bathing ball as claimed in claim 1, wherein said outer surface over said inner body conforms to the spherical shape of the inner body.

* * * * *